US006250564B1

(12) United States Patent
Chahley

(10) Patent No.: US 6,250,564 B1
(45) Date of Patent: Jun. 26, 2001

(54) FLOW CONTROL SYSTEM FOR SPRAYER NOZZLES

(75) Inventor: Dennis W. Chahley, Martensville (CA)

(73) Assignee: Flexi-Coil Ltd., Saskatoon (CA)

( * ) Notice: Subject to any disclaimer, the term of this patent is extended or adjusted under 35 U.S.C. 154(b) by 0 days.

(21) Appl. No.: 09/504,188

(22) Filed: Feb. 15, 2000

(30) Foreign Application Priority Data

Feb. 15, 1999 (CA) ..... 2262237

(51) Int. Cl.[7] ..... B05B 1/16; B05B 1/30
(52) U.S. Cl. ..... 239/170; 239/586
(58) Field of Search ..... 239/533.1, 533.15, 239/570, 583, 586, 170; 251/129.15, 129.02

(56) References Cited

U.S. PATENT DOCUMENTS

| | | | | |
|---|---|---|---|---|
| 3,701,356 | * | 10/1972 | Hanna et al. | 134/58 R |
| 3,878,859 | * | 4/1975 | Grob et al. | 251/129.02 |
| 3,979,062 | * | 9/1976 | Christensen et al. | 239/11 |
| 4,988,074 | * | 1/1991 | Najmolhoda | 251/129.08 |
| 5,143,345 | * | 9/1992 | Miki et al. | 251/129.02 |
| 5,154,394 | * | 10/1992 | DuHack | 138/46 |
| 5,413,308 | * | 5/1995 | Hayes | 251/129.02 |

* cited by examiner

*Primary Examiner*—David A. Scherbel
*Assistant Examiner*—Davis Hwu

(74) *Attorney, Agent, or Firm*—Larry W. Miller; John William Stader

(57) ABSTRACT

The present invention relates to a flow control system for sprayer nozzles. The control system includes a solenoid coil and a solenoid plunger. The solenoid plunger can slide into an adapter body, substantially perpendicular to the direction of fluid flow. In reducing the fluid flow through the nozzle, the plunger is moved to block an orifice in the path of the fluid flow, within the adapter. The plunger movement is achieved through the energization of the solenoid coil, with signals sent by a controller. The orifice in the adapter is manufactured to a specific size that allows reduced power consumption to shut off or reduce flow through the nozzle. Also, the orifice is sized to provide unrestricted flow when fully open. By means of the controller, control can be provided individually to each nozzle from a plurality of nozzles on a spraying bar. In one aspect of the invention, the flow control system can be used on agricultural sprayers with sensing equipment such as cameras that may determine the green condition of the foliage being sprayed. According to the determined condition, the controller would regulate the flow through the nozzles in the corresponding area of the field. The control valve adapts to industry standard fittings and adapts to a position on the fittings so the spray fluid passes through the filter and nozzle check valve before passing through the control valve while the nozzle check valve remains in place. Specifically, the control valve can be adapted onto a standard fitting and inserted.

36 Claims, 4 Drawing Sheets

FLOW CONTROL SYSTEM FOR SPRAYER NOZZLES

BACKGROUND OF THE INVENTION

This invention relates generally to sprayers and, particularly, to a flow control system for sprayer nozzles.

A typical spraying nozzle comprises a nozzle body, a diaphragm check valve, a nozzle body screen or filter, a nozzle tip and a nozzle cap. The diaphragm check valve shuts off the nozzle at a predetermined pressure. In the case of an agricultural field sprayer, a plurality of nozzles are usually mounted on a spraying bar, towed in the field by a tractor. Alternately, the sprayer could be self propelled. The number of the nozzles on the spraying bar is proportional to the width of the spraying bar.

Various systems have been proposed in the past for reducing or shutting off the fluid flow to a sprayer nozzle body.

Several prior art systems employ solenoid coils with a plunger that are either integral at the nozzle cap in non-standard nozzle bodies and can not be retrofitted to existing sprayer fittings, or are made to adapt to standard nozzle bodies at their check valve location requiring removal of the check and in such location are not filtered by the nozzle body filter. In operation, the coil is energized by a nozzle control system to open the plunger valve.

For agricultural sprayers, the control coils require at least 6 watts per nozzle, hence a large amount of power is drawn from a tractor on larger width units. In most cases, an extra power source is required on the tractor.

In the prior art, the coils are normally in a position with the plunger blocking the fluid path (position which is hereinafter called closed) and must be energized to activate the plunger to displace it to a position allowing fluid flow (position which is hereinafter called open). Therefore if a coil fails or power to the coil is disconnected, the fluid flow from the nozzle body to the tip is affected and there will be a down time in spraying, required to replace or to repair the defective coil.

On many of these prior art systems, the nozzle screen is positioned after the solenoid plunger, thus there is an increased chance that the plunger will become plugged with particles.

Additionally, most of the current nozzle control systems, lack the standard diaphragm check valve, which provides shut off to the nozzle at a predetermined pressure. Therefore, the flow through the nozzles must be controlled solely by the solenoid coils.

SUMMARY OF THE INVENTION

It is an object of the present invention to provide an improved flow control system for a sprayer nozzle assembly.

Another object of the present invention is to provide a flow control system for sprayer nozzles on agricultural machines, which is economical in terms of power consumption.

Still another object of the invention is to provide a flow control system for sprayer nozzles that is easily adaptable to nozzle assemblies available on the market.

According to the present invention, there is provided a flow control system comprising:

- a spray nozzle comprising a fluid passage, the fluid passage comprising a fluid spray outlet;
- a control valve mounted on the spray nozzle, the control valve comprising a actuator and a flow impeding device, whereby activation of the actuator causes the flow impeding device to move into the fluid passage of the spray nozzle thereby impeding fluid flow through the spray nozzle, the actuator being adapted for selective activation upon receipt of control signals from the control unit.

According to the present invention, there is further provided a flow control system comprising: a spray nozzle comprising a nozzle body, the nozzle body comprising a fluid spray outlet and a nozzle check valve; a fluid passage defined by a wall between the nozzle check valve and the fluid spray outlet; and a control valve mounted on the nozzle body and being switchable between a rest state wherein fluid is permitted to flow along the fluid passage, and an energized state wherein fluid flow is restricted through the fluid passage, the control valve being adapted to receive the control signals from the control unit for switching the control valve from the rest state to the energized state.

According to the present invention, there is further provided a control valve adapted to retrofit on a flow control system, the flow control system comprising: a nozzle body comprising a fluid spray outlet and a nozzle check valve; a fluid passage defined by a wall between the nozzle check valve and the fluid spray outlet; a nozzle screen mounted on the nozzle body; and the control valve mounted on the nozzle body between the nozzle screen and fluid spray outlet such that the nozzle screen is upstream and the fluid spray outlet is downstream from the control valve along the fluid passage.

The present invention relates to a flow control system for sprayer nozzles. The control system comprises a solenoid coil and a solenoid plunger. Alternatively, the solenoid plunger could be replaced with a valve, such as a spool valve. The solenoid plunger can slide into an adapter body, substantially perpendicular to the direction of fluid flow. In reducing the fluid flow through the nozzle, the plunger is moved to block, partially or completely, an orifice in the path of the fluid flow, within the adapter. The plunger movement is achieved through the energization of the solenoid coil, with signals sent by a controller. The design is such that the nozzle is fully open when the solenoid coil is not energized.

The orifice in the adapter may be manufactured to a specific size that allows reduced power consumption to shut off or reduce flow through the nozzle. This feature is especially useful when the system is used on agricultural sprayers with many nozzles. Furthermore, the orifice may be sized to provide unrestricted fluid flow when fully open.

The adapter may be inserted between the nozzle spray screen and the nozzle tip, for spraying nozzles that have the nozzle tip and the nozzle spray cap as separate pieces, or it may be inserted between the nozzle spray screen and a one piece nozzle spray tip-cap, for spraying nozzles provided with such a piece.

In operation, pressurized fluid is supplied to the nozzle. A diaphragm check valve will not open until a predetermined pressure is reached. When the fluid pressure exceeds the predetermined pressure, the diaphragm check valve opens, allowing fluid to flow through the nozzle body screen, through the adapter body, to the nozzle tip.

By means of the controller, each nozzle from a plurality of nozzles on a spraying bar can be individually controlled.

In one aspect of the invention, the flow control system can be used with agricultural prayers with sensing equipment, such as cameras that may determine the green condition of the foliage being sprayed. According to the determined condition, the controller would regulate the flow through the nozzles in the corresponding area of the field.

Advantageously, the spray control system of the invention can be adapted to off-shelf nozzle assemblies and can control individually each nozzle.

Other advantages, objects and features of the present invention will be readily apparent to those skilled in the art from a review of the following detailed description of preferred embodiments in conjunction with the accompanying drawings.

BRIEF DESCRIPTION OF THE DRAWINGS

The embodiments of the invention will now be described with reference to the accompanying drawings, in which.

DETAILED DESCRIPTION OF THE INVENTION

Figure 1:
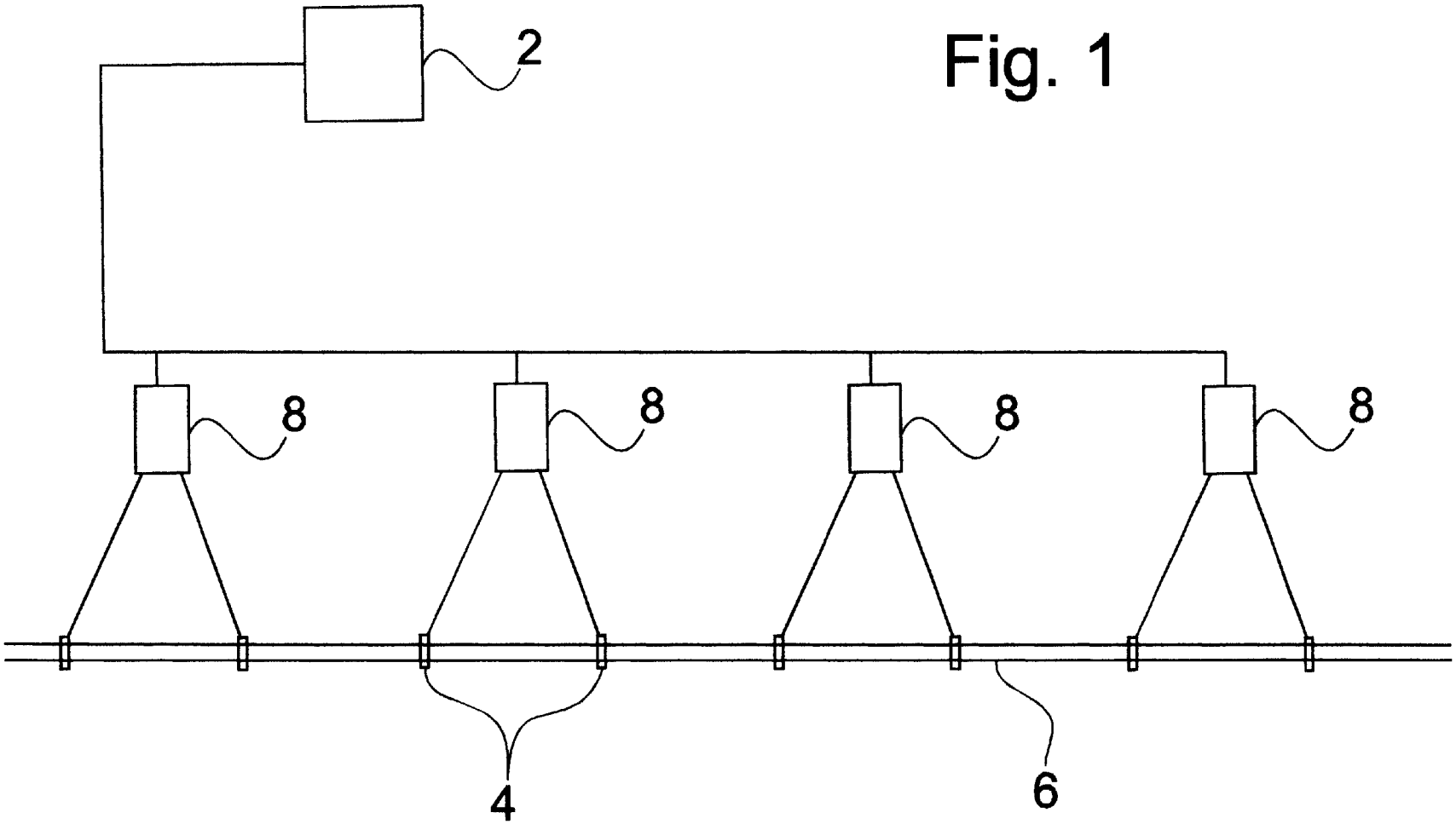
FIG. 1 is a block diagram of a sprayer system in accordance with an embodiment of the invention.

Referring to FIG. 1, a block diagram of a sprayer system 1 in accordance with an embodiment of the present invention is illustrated. The sprayer system comprises a controller or control unit 2 for monitoring a plurality of nozzles 4 mounted on a spraying bar or spraying pipe 6. A plurality of remote/sensor 8 units can be interposed between the controller 2 and the nozzles 4 on the spraying bar 6. The operation of the sprayer system 1 depicted here is described later on.

Figure 2:
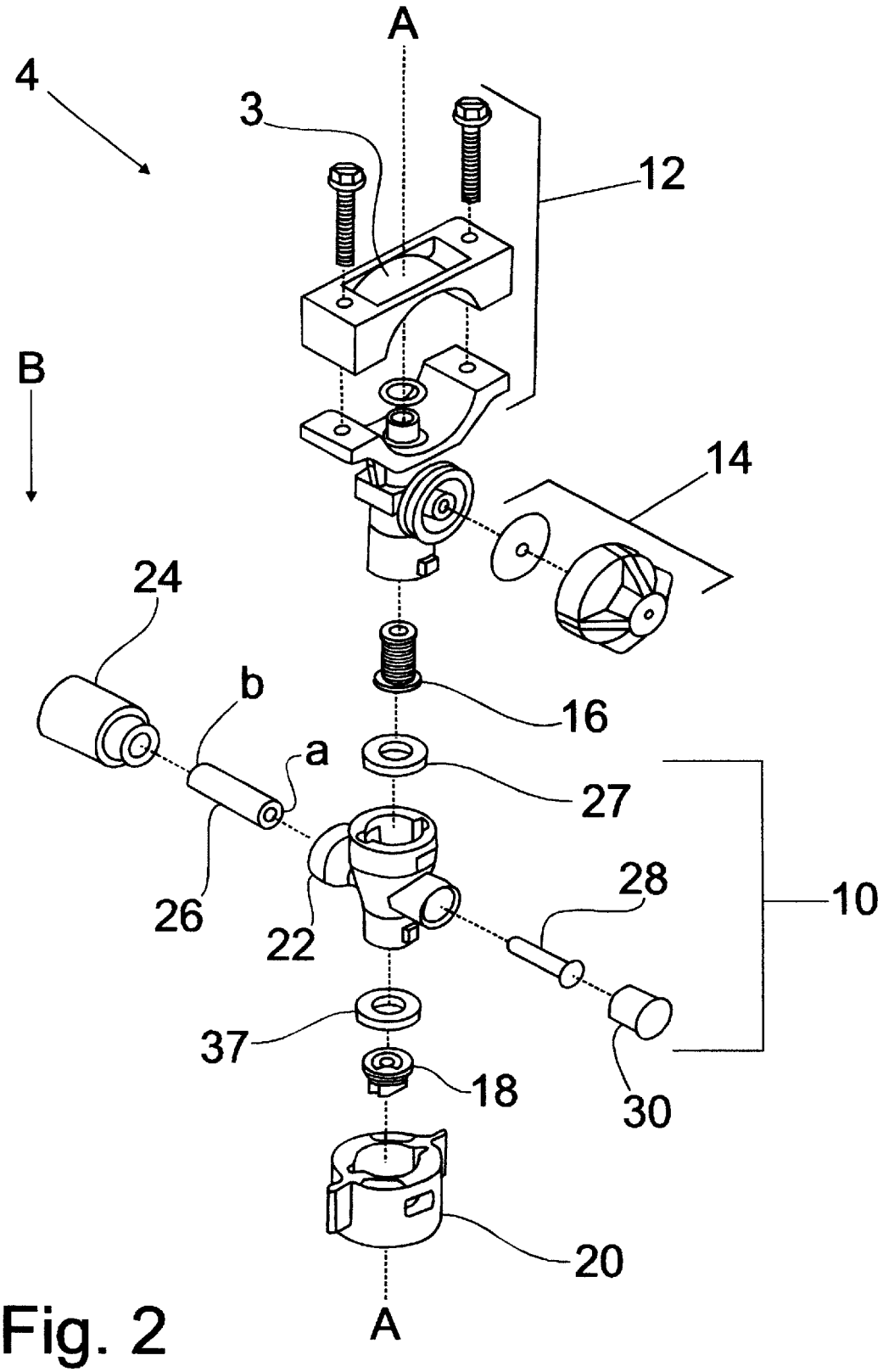
FIG. 2 is an exploded view of a nozzle flow control assembly in accordance with an embodiment of the invention.

Referring now to FIG. 2, the nozzle flow control assembly 10 of the present invention is shown as being adapted for attachment to an existing nozzle 4. A nozzle body assembly 4 typically comprises a nozzle body 12, a diaphragm check valve or nozzle check valve 14, a nozzle body screen or filter 16, a nozzle tip or fluid outlet 18 and a nozzle spray tip cap 20, all aligned along a longitudinal axis A—A. Axis A—A will be referred to as the nozzle axis for the purpose of this document. Fluid flows from nozzle body 12 to tip 18 as shown by arrow B.

Figure 3A:
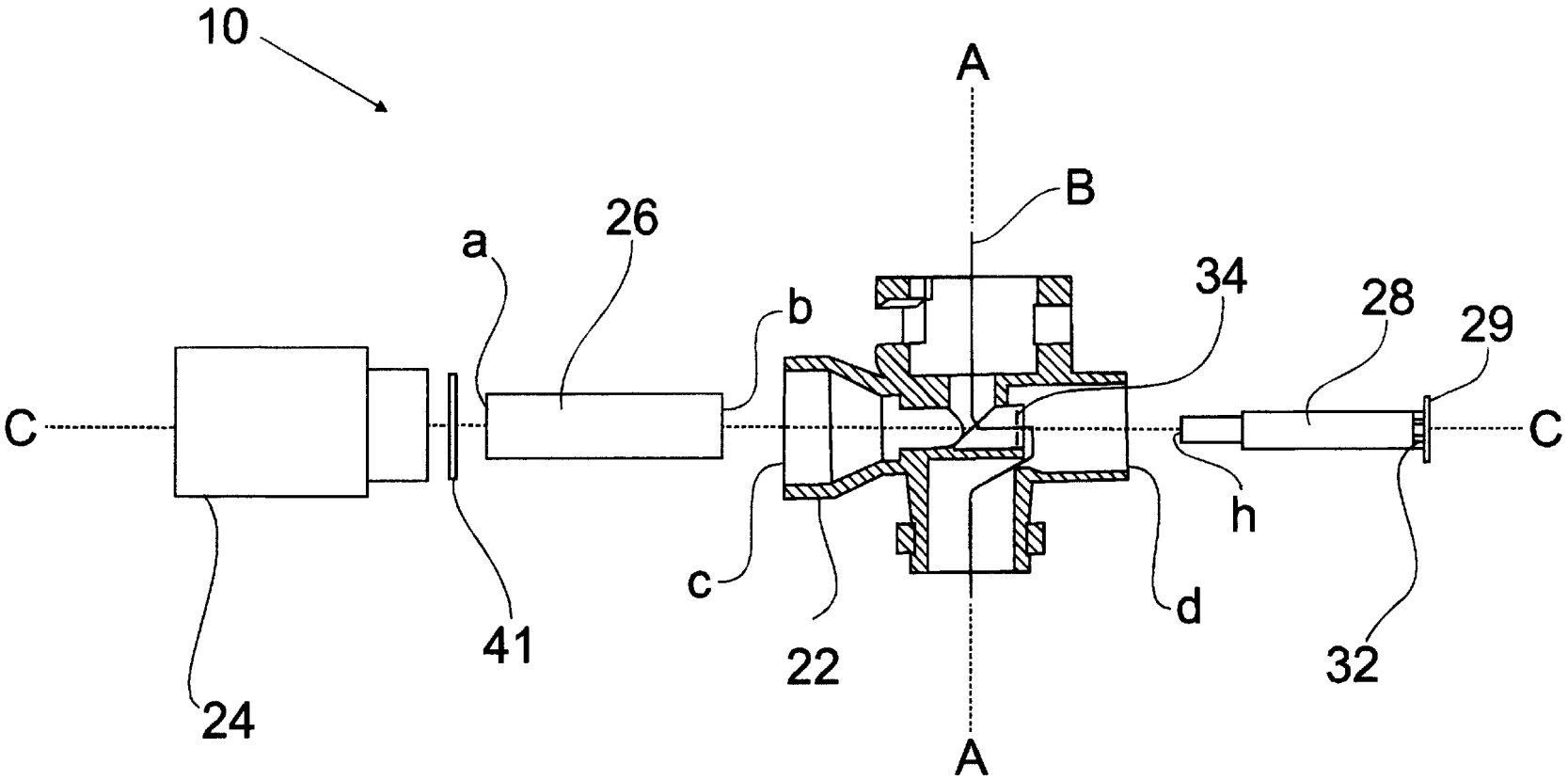
FIG. 3A is a cross-sectional view of a nozzle flow control system using a through adapter and a pull-to-close solenoid, in accordance with one aspect of the invention.
Figure 3B:
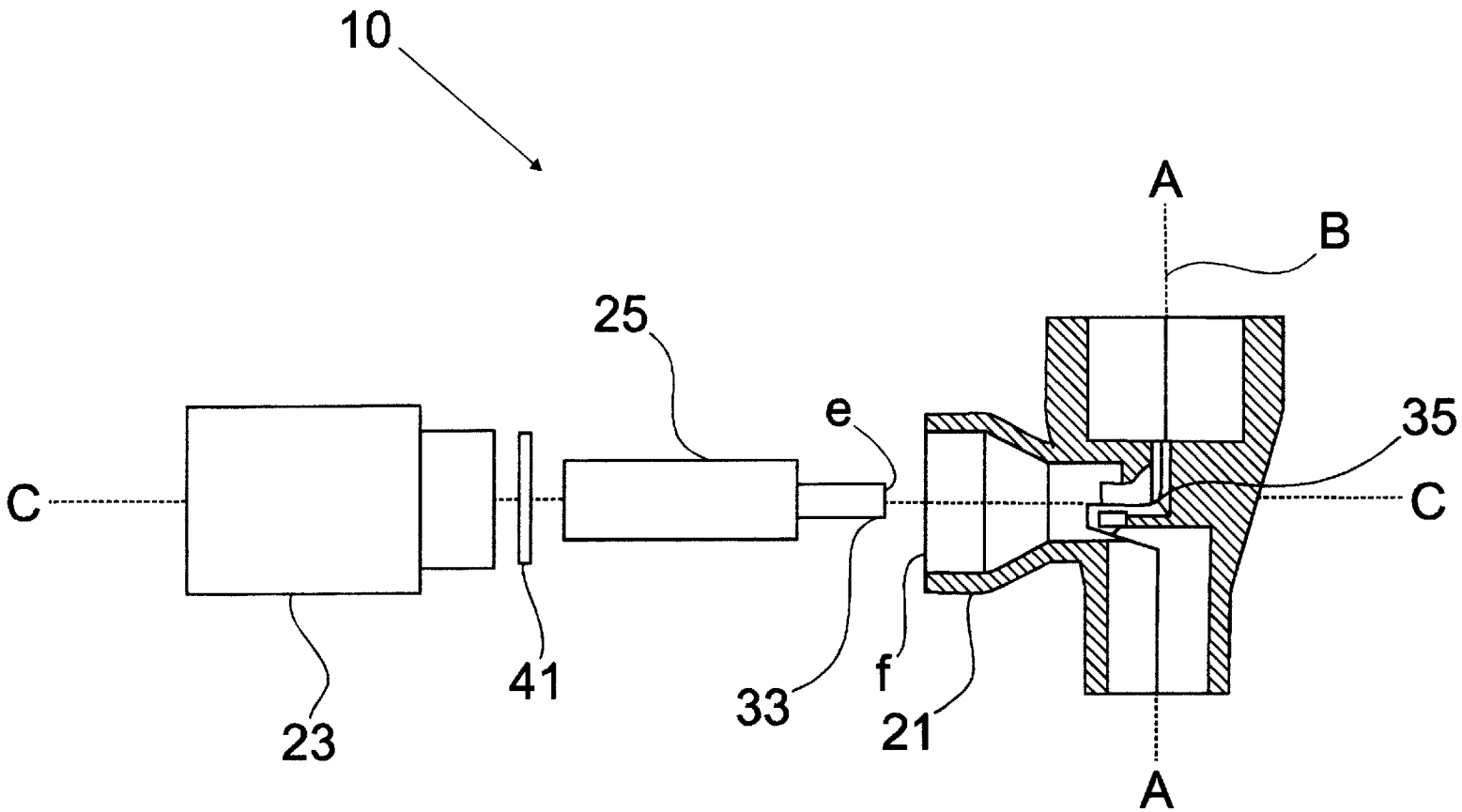
FIG. 3B is a cross-sectional view of a nozzle flow control system using a tee adapter and a push-to-close solenoid, in accordance with another aspect of the invention.

The nozzle flow control assembly 10 is placed between the nozzle body screen 16 and nozzle tip 18, and, as the name indicates, it serves to control the fluid flow through the nozzle 4. In the case when the nozzle tip 18 and the nozzle cap 20 are manufactured as one piece, the nozzle flow control assembly 10 is placed between the nozzle body screen 16 and the one piece nozzle spray tip cap. The nozzle flow control assembly 10 comprises an nozzle adapter 22. The nozzle adapter 22 has to support a solenoid coil 24 and/or a flow impeding device 26, 28. It should be noted that the flow impeding device 26, 28 is ideally a solenoid plunger, but could also be a valve, such as a spool valve. The adapter 21, 22 can be any type of adapter such as a tee adapter as shown in FIG. 3B or a through adapter as shown in FIG. 3A. The solenoid could also be replaced with any other actuating means, such as a motor or hydraulic.

Referring also to FIGS. 3A and 3B, the adapter has an orifice 34, 35, for sealing off the fluid flow B to the nozzle tip. The orifice 34, 35 is provided within the wall at the level in the detour of the nozzle adapter and has a cross-sectional plane at an angle to the nozzle axis A—A. Preferably, this angle is 90°. The orifice 34, 35 is manufactured to a specific size which allows reduced power consumption to shut off flow to the nozzle, as it will be further described. The size of the orifice is such that it provides unrestricted fluid flow when fully open, so that it has no effect on fluid flow typical to required operation.

The solenoid coil 23, 24 is placed into the adapter body 21, 22 transversal to the cross-sectional plane of the orifice 34, 35. A 'push to close' type solenoid 23 is suited for a tee adapter 21 (FIG. 3B) and a 'pull to close' type solenoid 24 is suited for a through adapter 22 (FIG. 3A). The plunger 25, 26, 28 is adapted to slide along the axis of the solenoid coil 23, 24 in response to energization (activation) of the solenoid coil 23, 24.

FIG. 3A shows a cross-section of the nozzle flow control assembly using a through type adapter 22 and a pull-to-close solenoid 24, 26 and 28. As depicted in FIGS. 2 and 3A, in the case of a through type adapter 22, the plunger comprises two pieces, piece 26 and piece 28, each adapted to fit inside the adapter 22, along an axis C—C normal to the cross-sectional plane of the orifice 34. Piece 26 of the plunger is adapted to slide with its end b into open end c of the adapter 22. Piece 28 of the plunger is adapted to slide with its end h through the open end d of the adapter 22, and further through the orifice 34. Piece 28 of the plunger has an enlarged cross-section region 29 at its end i. When the solenoid coil 24 is activated, piece 26 of the plunger pulls piece 28 through the orifice in the adapter body 22. The enlarged cross-section region 29 allows piece 28 slide only partially through the orifice 34, thus shutting off the fluid flow B.

In order to block the orifice 34 efficiently, the pulling force created by energizing the solenoid coil 24 has to overcome the force exerted by the fluid flowing onto the enlarged cross-section region 29 at end i of piece 28. For an efficient design, the power applied to the solenoid coil 24 must be minimal, thus the pulling force must be minimal. Therefore, in a preferred embodiment, the force exerted by the fluid onto the enlarged cross-section region 29 is minimized. The force exerted by the fluid flow onto the enlarged cross-section region 29, is directly proportional with the pressure of the fluid and to the surface area of this region. As the pressure within the fluid is predetermined, the force is minimized by minimizing the total surface area of the enlarged cross-section region 29, onto which the fluid flows. Therefore, the remaining of piece 28 must have a cross-section small enough to allow it to slide through the orifice 34, but large enough so as to allow only a very small surface area of the enlarged cross-section region 29 to be in contact with the fluid, in the closed position. In turn, the size of orifice 34 can be manufactured to render reduced power consumption, according to the principles described.

When the solenoid is no longer energized, the pressure exerted by the fluid flowing onto the enlarged cross-section region 29 of piece 28 pushes plunger 26, 28 open, and fluid can flow through the orifice 34.

A seal 32 is preferably mounted on the plunger at end i of piece 28. The purpose of the seal 32 is to seal against fluid flow through the orifice 34 in the adapter body 22, in the closed position.

In a preferred embodiment, end h of piece 28 is threaded externally, and end b of piece 26 has an inner bore threaded so as to engage end h of piece 28.

FIG. 3B shows a cross-section of the nozzle flow control assembly 10 using a tee type adapter 21 and a push-to-close solenoid 23. In this embodiment, the plunger 25 is adapted to slide with end e into open end f of the adapter 21 along the axis C—C normal to the cross-sectional plane of the orifice 35. End b of the plunger 25 has a cross-section larger than the size of the orifice 35. When the solenoid coil 23 is activated, the plunger 25 is forced into the adapter 21, causing seal 33 to seat against orifice 35, blocking the flow. For completely closing the orifice 35, the force applied to push plunger 25 into blocking the orifice 35, must be greater than the force exerted by the fluid onto the end e of the plunger 25. The force exerted by the fluid onto end e of the plunger 25 is directly proportional to the surface area of the end e plunger, contacted by the fluid. In a fully closed position, this surface area is substantially the same as the cross-sectional area of the orifice 35. Thus, the amount of power required to fully close the orifice 35 is directly proportional to the cross-sectional area of the orifice 35.

A seal 33 is mounted on the plunger 25 at end e. The purpose of the seal 33 is to seal against fluid flow through the orifice 35 in the adapter body 21, in the closed position.

In general, a partially closed position is achieved if the signal applied to the solenoid coil is not fully energized. In such a case, the plunger will only be partially closed to a position in which the closing force is balanced with the fluid pressure acting on the plunger. Hence, the fluid flow through the orifice, and thus through the nozzle, is only reduced but not completely shut off.

The plunger size and seal type match up to the push or pull type solenoid.

An O ring 41 is preferably fitted between the solenoid coil and the plunger for better sealing.

In an alternative embodiment, a solenoid activated plunger can be used to open or close a flapper or a diaphragm blocking an orifice in the path of the fluid flow, rather than pressing a seal against that orifice.

Preferably, nozzle cap gaskets 27, 37 are inserted between the adapter and each of the nozzle body and the nozzle tip, respectively.

For simplicity, the operation of the flow control system according to the invention will be described in the context of its application to an agricultural sprayer, but it has to be appreciated that the use of the invention can extend to any system where there is a need to provide flow control to a spraying nozzle.

In operation, pressurized fluid is supplied to the nozzle body 4 through the port 3. The diaphragm check valve 14 will not open until a predetermined pressure, for example 7–10 psi, is reached. When the fluid pressure exceeds the predetermined pressure, the diaphragm check valve 14 opens, allowing fluid to flow through the nozzle body screen 16, and through the adapter body 21, 22, to the nozzle tip 18. The fluid is then distributed onto the foliage being sprayed. By means of the controller 2, flow control can be provided individually to each nozzle 4 and to a plurality of nozzles on the spraying bar 6.

Referring to FIGS. 1, 2 and 3A, the normally open orifice 34 allows fluid to flow to the nozzle tip 18 at all times unless the solenoid coil 24 is activated by the controller 2 into closing it, partially or fully, which reduces or stops the fluid flow to the nozzle 4. The open and closed states of a particular nozzle, as controlled by the controller 2, correspond to a de-energized and an energized state of the solenoid coil from the corresponding nozzle flow control assembly, respectively. In one embodiment, the control of the nozzles is achieved by means of remote sensors 8, each corresponding to a certain group of nozzles 4. The remote sensors 8 sense the condition of the foliage being sprayed in the area of the nozzles 4 that correspond to them, and send to the controller 2 signals indicating whether the amount of flow through the corresponding nozzles 4 must be increased or reduced.

Since the nozzles are normally in an rest state, power is drawn from the transport vehicle (e.g. a tractor) only when a nozzle has to be closed, which entails activating its solenoid coil. Hence, the power consumption is proportional to the length of time the solenoid coils must be activated, thus closing the nozzles. Therefore, in the case of a field with many weeds, the power consumption will be smaller than in prior-art systems in which control solenoid coils of equal size are activated to keep the nozzles open. In the present invention, because of the normal, deactivated, open state of the solenoid coils, if a coil fails or if the coil is disconnected, the fluid flow from the nozzle body to the nozzle tip is not affected and the operator can continue spraying with no down time for replacing the coil.

Because the nozzle screen is placed before the solenoid plunger, the chances of the plunger becoming jammed from particles are reduced.

Turning now to FIG. 1, the present invention can be used in conjunction with sensors, cameras and means providing in cab-monitoring of various conditions such as green condition of foliage, or of soil nutrient resources.

Through signals received from the remote sensors 8 or from cameras installed close to the nozzles, the controller recognizes the areas that do not require spraying and stops fluid flow to the nozzles corresponding to those areas. Similarly, the controller can recognize areas that require less spraying and allow a reduced fluid flow through the corresponding nozzles.

Based on the logic built into it, the controller can decide what type of signal to send to each individual solenoid coil, controlling a particular nozzle. The controller may send a fully energized signal, a partially energized signal, a pulsed signal with a specific duty cycle, or any other signal.

Fully energized signals completely shut off the corresponding nozzles. Partially energized signals or signals pulsed at a specific duty cycle allow a reduced amount of flow on corresponding areas.

As shown in FIG. 1, cameras or vision system sensors 8 are mounted ahead of nozzles 4. For example, one camera or other remote sensor 8 controls a certain number of nozzles. In the embodiment presented in FIG. 1, a remote sensor 8 controls two adjacent nozzles 4. As the sprayer is pulled through a field, the cameras 8, which are directed at the ground, look for green plants. In one aspect of the invention, on reaching an operator set level for the amount of green the camera must see, the camera sends a signal to fully open the nozzle controller, allowing a green area to be sprayed with chemical. If a camera does not see a sufficient amount of green according to the operator set level in a certain area, a pulsed signal is sent by the controller to apply a reduced application rate over that area.

The present system can be used with a monitor with a task controller connected to a Global Positioning System (GPS). In addition, the operator can input into the controller a herbicide prescription map, corresponding to the field being sprayed. By recognizing its position in the field, with the aid of the GPS system, and identifying the requirements of the particular area based on the provided prescription map, the controller would signal each individual nozzle to be open, closed, or active at a certain duty cycle.

Additionally, with the above described system, overlapping in spraying can be greatly reduced, so that any given area of the field is sprayed only once. The controller would just have to shut off the overlapping nozzles.

It will be understood by those skilled in the art that the controller can be programmed to determine the necessity for spraying based on a variety of conditions, to control the solenoid nozzles individually or in any combination, to send to the solenoid coils any type of energizing signals or other like functions.

Numerous modifications, variations and adaptations may be made to the particular embodiments of the invention described above without departing from the scope of the invention, which is defined in the claims.

Having thus described the invention, what is claimed is:

1. A flow control system adapted to receive control signals from a control unit comprising:

a spray nozzle defining a fluid passage, the fluid passage terminating at a fluid spray outlet;

a control valve mounted on the spray nozzle, the control valve including an actuator and a flow impeding device, whereby activation of the actuator causes the flow impeding device to move into the fluid passage of the spray nozzle against the flow of fluid through said control valve thereby impeding fluid flow through the spray nozzle, said flow impeding device being moved to a non-impeding position by the force of the fluid flowing through said control valve, the actuator being adapted for selective activation upon receipt of control signals from the control unit.

2. A flow control system as defined in claim 1, wherein the flow impeding device is a plunger and said actuator is a solenoid coil.

3. A flow control system as defined in claim 2, wherein said plunger has a first plunger member located adjacent said solenoid coil on a first side of said control valve and a second plunger member positioned on a second side of said control valve opposite said first side, said second plunger member moving into said fluid passage when said solenoid coil is activated.

4. A flow control system as defined in claim 3, wherein said second plunger member is pushed out of said fluid passage when said solenoid coil is deactivated permitting said fluid passage to be unrestricted by said flow impeding device.

5. A flow control system adapted to receive control signals from a control unit comprising:

a spray nozzle defining a nozzle body, the nozzle body including a fluid spray outlet and a nozzle check valve;

a fluid passage extending between the nozzle check valve and the fluid spray outlet; and a control valve including an actuator, a flow impeding device operatively connected to said actuator for plugging the fluid passage, and a nozzle adapter connected between the nozzle check valve and the fluid spray outlet, the nozzle adapter providing the fluid passage and including an orifice in a wall defining the fluid passage, said control valve being mounted on the nozzle body and being switchable between a rest state wherein said flow impeding device is removed from said fluid passage and fluid is permitted to flow unrestricted along the fluid passage, and an energized state wherein said flow impeding device is moved into the fluid passage and said fluid flow is restricted through the fluid passage, the control valve being adapted to receive control signals from the control unit for switching the control valve from the rest state to the energized state.

6. A flow control system as defined in claim 5, wherein the nozzle check valve is opened by a predetermined fluid pressure.

7. A flow control system as defined in claim 6, wherein the control signal is a dc signal.

8. A flow control system as defined in claim 5, wherein the actuator is a solenoid coil energized by the control unit for creating an electromagnetic field upon receipt of the control signal.

9. A flow control system as defined in claim 5, wherein the flow impeding device is a plunger having a first plunger member located adjacent said solenoid coil on a first side of said control valve and a second plunger member positioned on a second side of said control valve opposite said first side, the plunger being operatively connected to the solenoid coil for converting the electromagnetic field into a displacement between a rest position wherein the control valve is in the rest state, and an energized position wherein the control valve is in the energized state.

10. A flow control system as defined in claim 9, wherein the second plunger member moves into the fluid passage when said solenoid coil is activated and is pushed out of said fluid passage and into a non-impeding position by the force of fluid flowing through said control valve when said solenoid coil is deactivated thereby permitting said fluid passage to be unrestricted by said flow impeding device.

11. A flow control system as defined in claim 9, wherein the nozzle adapter is a tee type adapter and the solenoid is a push-to-close type solenoid.

12. A flow control system as defined in claim 10, wherein the nozzle adapter is a through-type adapter and the solenoid is a pull-to-close type solenoid.

13. A flow system as defined in claim 5, wherein the nozzle adapter comprises:

a longitudinal axis aligned with the fluid passage, and a portion where it forms a detour, a orifice being provided within the wall at the level of the detour.

14. A flow control system as defined in claim 5, further comprising:

a nozzle screen positioned such that the control valve means is inserted between the nozzle screen and the fluid spray outlet.

15. A flow control system as defined in claim 5, wherein activation of the actuator causes the flow impeding device to move into the fluid passage of the spray nozzle against the flow of fluid through said control valve thereby impeding fluid flow through the spray nozzle, said flow impeding device being moved to a non-impeding position by the force of the fluid flowing through said control valve.

16. An agricultural sprayer for spraying liquid onto a field comprising:

a transverse spraying bar having a plurality of transversely spaced spraying nozzles mounted on the spraying bar defining respective fluid passages for directing a spray of said liquid on the field;

a flow control system associated with each respective said nozzle for individually controlling the flow of said liquid through each respective said nozzle, said control system being switchable between a rest state wherein fluid is permitted to flow along the fluid passage, and an energized state wherein fluid flow is restricted through the fluid passage; and a control unit for generating signals for each said flow control system to switch said flow control system between said rest state and said energized state.

17. The agricultural sprayer as defined in claim 16, wherein said flow control system includes a spray nozzle defining a fluid passage extending between a nozzle check valve and a fluid spray outlet, the nozzle check valve being opened by a predetermined fluid pressure.

18. The agricultural sprayer as defined in claim 17, wherein the flow control system further includes a control valve, said control valve comprising:

a nozzle adapter connected between the nozzle check valve and the fluid spray outlet, the nozzle adapter for providing the fluid passage and including an orifice in a wall defining the fluid passage; and a solenoid for plugging the fluid passage on receipt of the signal.

19. The agricultural sprayer as defined in claim 18, wherein the orifice comprises a cross section that is normal to the path of fluid flow to allow unrestricted fluid flow when the orifice is unplugged.

20. The agricultural sprayer as defined in claim 18, wherein the nozzle adapter is a tee type adapter and the solenoid is a push-to-close type solenoid.

21. The agricultural sprayer as defined in claim 18, wherein the nozzle adapter is a through-type adapter and the solenoid is a pull-to-close type solenoid.

22. The agricultural sprayer as defined in claim 18, wherein the solenoid comprises:

a solenoid coil energized by the control unit for creating an electromagnetic field upon receipt of the control signal; and a plunger located within the control valve, the plunger including a first plunger member located adjacent said solenoid coil on a first side of said control valve and a second plunger member positioned on a second side of said control valve opposite said first side, said plunger being operatively connected to the solenoid coil for converting the electromagnetic field into a displacement between said rest position wherein the control valve is in a rest state, and said energized position wherein the control valve is in the energized state.

23. The agricultural sprayer as defined in claim 22, wherein said second plunger member moves into the fluid passage when said solenoid coil is activated and is pushed out of said fluid passage and into a non-impeding position by the force of fluid flowing through said control valve when said solenoid coil is deactivated.

24. The agricultural sprayer as defined in claim 23, wherein when said second plunger member is pushed out of said fluid passage, said fluid passage is unrestricted by said second plunger member.

25. The agricultural sprayer as defined in claim 18, wherein the nozzle adapter comprises:

a longitudinal axis aligned with the fluid passage, and a portion where it forms a detour, the orifice being provided within the wall at the level of the detour.

26. The agricultural sprayer as defined in claim 16, wherein the signal is a dc signal.

27. A control valve adapted to retrofit on a flow control system, the flow control system comprising:

a nozzle body including a fluid spray outlet and a nozzle check valve;

a fluid passage extending between the nozzle check valve and the fluid spray outlet;

a nozzle screen mounted on the nozzle body;

a solenoid; wherein the solenoid includes:

a solenoid coil energized by the control unit for creating an electromagnetic field upon receipt of the control signal; and a flow impeding device, including a first plunger member located adjacent said solenoid coil on a first side of said control valve and a second plunger member positioned on a second side of said control valve opposite said first side.

28. A control valve as defined in claim 27, further comprising:

a nozzle adapter connected between the nozzle check valve and the fluid spray outlet, the nozzle adapter for providing the fluid passage and comprising an orifice in the wall of the fluid passage.

29. A control valve as defined in claim 27 being adapted to receive control signals from a control unit, wherein the control valve is switchable between a rest state when fluid is permitted to flow along the fluid passage, and an energized state when fluid flow is restricted through the fluid passage, the control valve being adapted to switch from the rest state to the energized state upon receipt of the control signals.

30. A control valve as defined in claim 29, wherein the control signal is a dc signal.

31. A control valve as defined in claim 27, further comprising:

a nozzle adapter connected between the nozzle check valve and the fluid spray outlet the nozzle adapter for providing the fluid passage and comprising an orifice in a wall defining the fluid passage.

32. A control valve as defined in claim 31 wherein the nozzle adapter is a tee type adapter and the solenoid is a push to close type solenoid.

33. A control valve as defined in claim 31, wherein the nozzle adapter is a through type adapter and the solenoid is a pull to close type solenoid.

34. A control valve as defined in claim 27 wherein said plunger is operatively connected to the solenoid coil for converting the electromagnetic field into a displacement between a rest position wherein the control valve is in the rest state, and an energized position wherein the control valve is in the energized state.

35. A control valve as defined in claim 34, wherein said second plunger member moves into the fluid passage when said solenoid coil is activated and is pushed out of said fluid passage and into a non-impeding position by the force of fluid flowing through said control valve when said solenoid coil is deactivated.

36. A control valve as defined in claim 35, wherein when said second plunger member is pushed out of said fluid passage, said fluid passage is unrestricted by said second plunger member.

* * * * *